United States Patent [19]

Schwartz

[11] Patent Number: 4,705,342

[45] Date of Patent: Nov. 10, 1987

[54] ELECTRICAL EXTENSION OUTLET

[75] Inventor: Frederic W. Schwartz, Providence, R.I.

[73] Assignee: Cable Electric Products, Inc., Providence, R.I.

[21] Appl. No.: 797,277

[22] Filed: Nov. 12, 1985

[51] Int. Cl.[4] ..... H01R 21/00

[52] U.S. Cl. ..... 439/650

[58] Field of Search ..... 339/154, 156 R, 157 R, 339/157 C, 159 R, 164 R, 164 M, 147 R, 147 P, 196 M, 147 R, 198 R, 198 J, 198 S, 198 P

[56] References Cited

U.S. PATENT DOCUMENTS

| | | | |
|---|---|---|---|
| 2,968,689 | 1/1961 | Johnson | 339/198 J |
| 4,113,334 | 9/1978 | Instone | 339/157 R |
| 4,245,880 | 1/1981 | Zimmerman | 339/157 R |
| 4,419,554 | 12/1983 | Osika | 339/147 R |
| 4,493,515 | 1/1965 | Banks | 339/164 M |

FOREIGN PATENT DOCUMENTS

| | | | |
|---|---|---|---|
| 2915587 | 10/1980 | Fed. Rep. of Germany | 339/147 R |

*Primary Examiner*—Eugene F. Desmond
*Assistant Examiner*—David Pirlot
*Attorney, Agent, or Firm*—Paul J. Sutton

[57] ABSTRACT

The invention features an electrical extension outlet that is easily assembled and which provides internal isolation to wiring and socket contacts. The components of the outlet are assembled by means of snap fasteners. A double housing and base member construction doubly shields wiring and contacts. Care is taken in the internal design to isolate all metal fasteners from wiring and contacts.

15 Claims, 12 Drawing Figures

24
55
53
20
19
11
13
28
29
26
12
27
35
14
36
30
34
20
31
71
19a
15
70
72
73
23
16a
22c
22b
16b
41
16c
39
22
29
37
38
43
18
16

ELECTRICAL EXTENSION OUTLET

FIELD OF THE INVENTION

The invention relates to outlet extensions providing a multiple socket arrangement and more particularly to a multiple socket outlet that is easily assembled and provides improved electrical isolation of sockets and wires.

BACKGROUND OF THE INVENTION

In recent times the multiple socket electrical extension components from a single power socket source. Such extensions provide flexibility in that several plugs are neatly arranged along a socketed outlet, wherein wires do not become entangled or overlap each other causing a "rat-nest" appearance.

Such multiple socketed arrangements provide convenience in that the components plugs are easily accessible, and they do not have to fight for space about a single socketed outlet.

Such extension outlets bring a multiplicity of sockets away from inaccessible wall areas thus providing a greater freedom to arrange components about a room.

Such extension outlets also provide greater safety in that each socket is commonly grounded, and the extension outlet may be provided with a circuit breaker which will prevent power overload in addition to household circuit protection.

The present electrical extension outlet or this invention is designed to be safer and more easily assembled. All or most of the individual parts of the extension are designed to easily snap together so that assembly will be achieved in mass-produced fashion. The internal wiring and electrical contacts are all shielded or isolated from extraneous metal fasteners, such that the chance of internal shorting is eliminated or greatly reduced.

BRIEF SUMMARY OF THE INVENTION

The invention features an easily assembled electrical extension outlet having a multiplicity of electrical sockets disposed in seriatim about elongated base member. The sockets have contacts that are wired together in common ground and are doubly electrically isolated by means of being disposed within a base member which is itself encased in a housing. The base member is easily assembled to the housing by irreversible snap fasteners that are integrally molded about the base member. The base member snaps into a front aperture in the housing, and a rear plate covers a rear aperture in the housing. The rear plate is screw fastened into blind holes in the housings thus isolating the interval wiring from metal contact.

The top surface of the base member contains the socket holes defining the individual sockets. The base member contains the contacts and wiring for these sockets, and isolates them from contact with other extensions outlet parts.

A switch is disposed in the top surface of the base member. The switch is an illuminated rocker that indicates when the sockets are powered. The switch is assembled to the base member by snap fasteners.

A circuit breaker having its own casing is electrically connected between the switch and a power cord which enters the housing through a side wall.

The rear plate of the housing contains apertures for receiving wall mounting fasteners. The fasteners used to mount the extension outlet to the wall are isolated from internal wiring by means of surrounding cylindrical wells molded into the rear plate. The base member has flanges which fit over and electrically isolate the well openings.

It is an object of this invention to provide an improved electrical extension outlet;

It is another object of the invention to provide an electrical extension outlet that is easily assembled by snap action fastener;

It is still another object of the invention to provide double isolation to the internal wiring and contacts of the sockets of an electrical outlet extension.

DETAILED DESCRIPTION OF THE INVENTION

Figure 1:
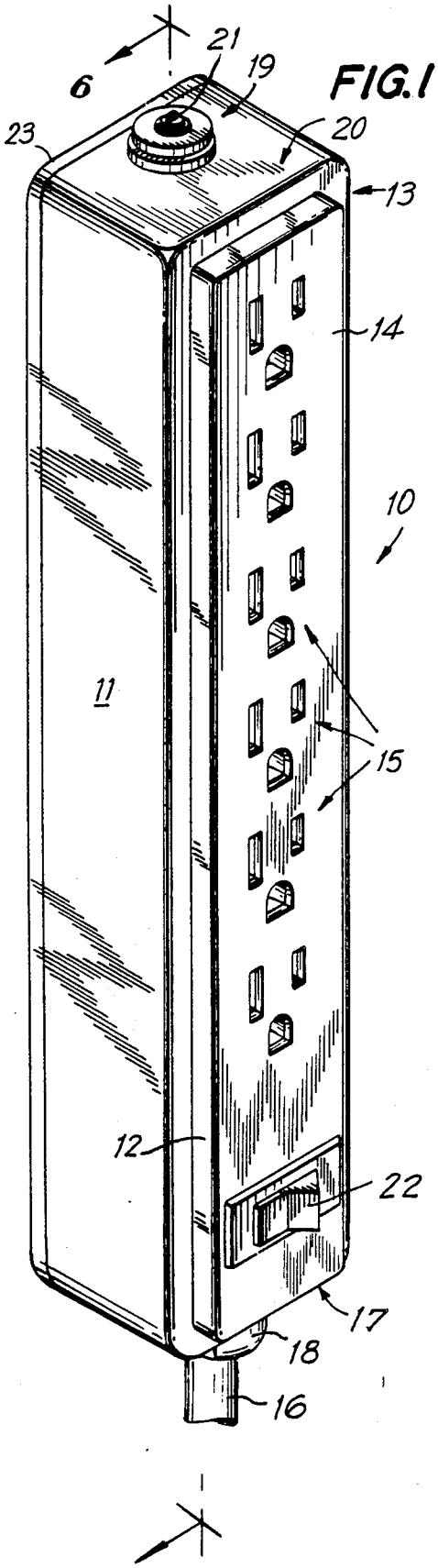
FIG. 1 is a perspective view of the electrical outlet extension of the invention.
Figure 2:
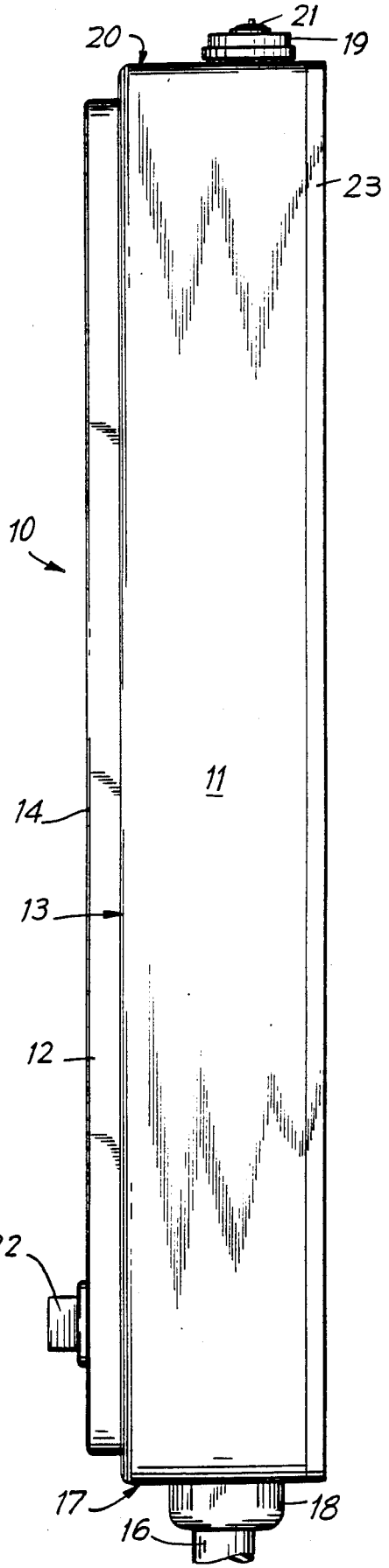
FIG. 2 is a side view of the electrical extension outlet illustrated in FIG. 1.

Generally speaking, the invention features an electrical extension outlet that is easily assembled by snap-action fasteners. The outlet also features a double isolation of internal wiring and contacts.

Now referring to FIGS. 1–5, the electrical extension outlet 10 of this invention is shown. The electrical extension outlet 10 comprises a housing 11 having a base member 12 disposed on a front surface 13. The base member 12 has a plurality of holes in a top surface 14 defining a plurality of electrical sockets 15 arranged in seriatim. There are six sockets 15 shown in FIG. 1, but this is only exemplary, and more or less sockets 15 can be disposed in the base member 12 as befits the purpose.

The outlet 10 also comprises a power cord 16 which supplies current to sockets 15. The power cord 16 has a plug (not shown) which connects to a standard wall socket. The power cord 16 is fed into outlet 10 through a rear end wall 17 in housing 11 and is anchored to the housing 11 by means of a strain relief grip 18, as depicted in FIGS. 1–3 and 5. The cord 16 has three power leads **16*a*, 16*b* and 16*c*, respectively, wherein lead 16*c* is a common ground lead. The leads 16*a*, 16*b* and 16*c* connect to the internal contacts (not shown) of each socket 15**, as is known in the art.

The power cord 16 supplies current to sockets 15 via a circuit breaker 19 disposed in a tip end wall 20 of housing 11. The circuit breaker 19 detects an overload condition in any one, or a combination of sockets 15, and cuts the power thereto. A reset button 21 allows for reinstituting the supply of current.

On the top surface 14 of the base member 12 is disposed a rocker switch 22. When the rocker switch 22 is thrown to an actuated position, it allows current from the power cord 16 to flow to sockets 15. When actuated, the rocker switch 22 becomes illuminated to indicate that the sockets 15 are energized.

Figure 3:
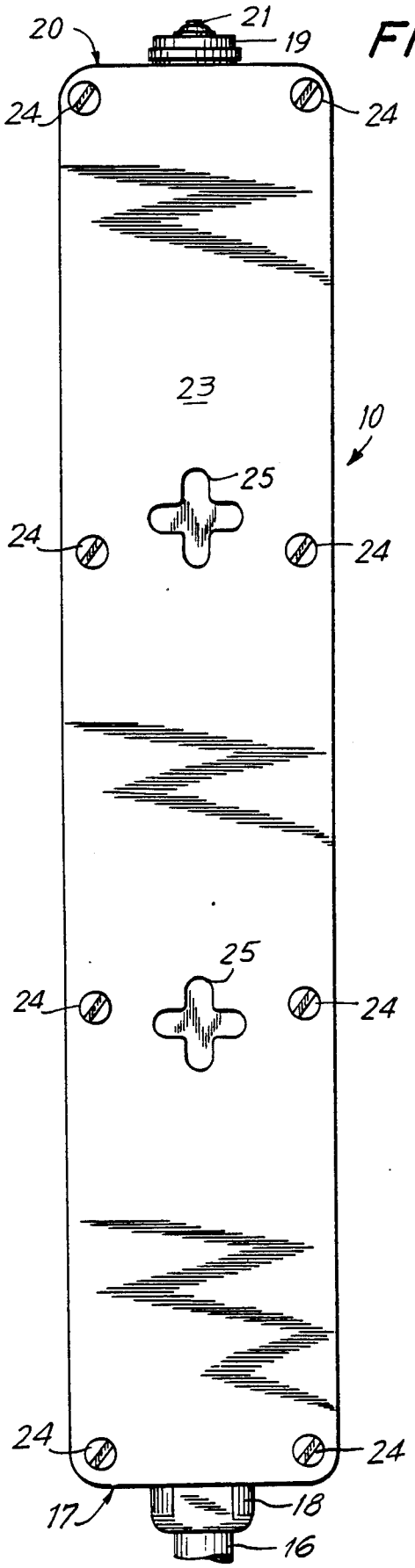
FIG. 3 is a back view of the electrical extension outlet shown in FIG. 1.
Figure 4:
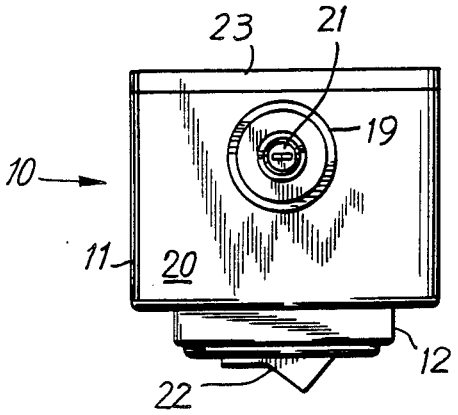
FIG. 4 is a top end view of the electrical extension outlet depicted in FIG. 1.
Figure 5:
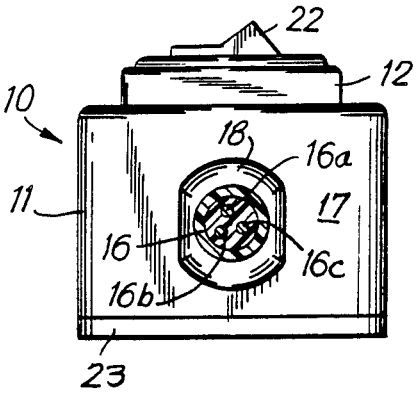
FIG. 5 is a rear end view of the electrical extension outlet shown in FIG. 1.

A rear cover plate 23 is affixed to the housing 11 by means of eight metal screws 24, as shown in FIG. 3.

The cover plate 23 contains two apertures 25 for holding wall screws, whereby the outlet 110 can be affixed or mounted to a wall.

Now referring to FIGS. 6–12, the construction and assembly of the outlet 10 will be shown and described in detail.

Figure 12:
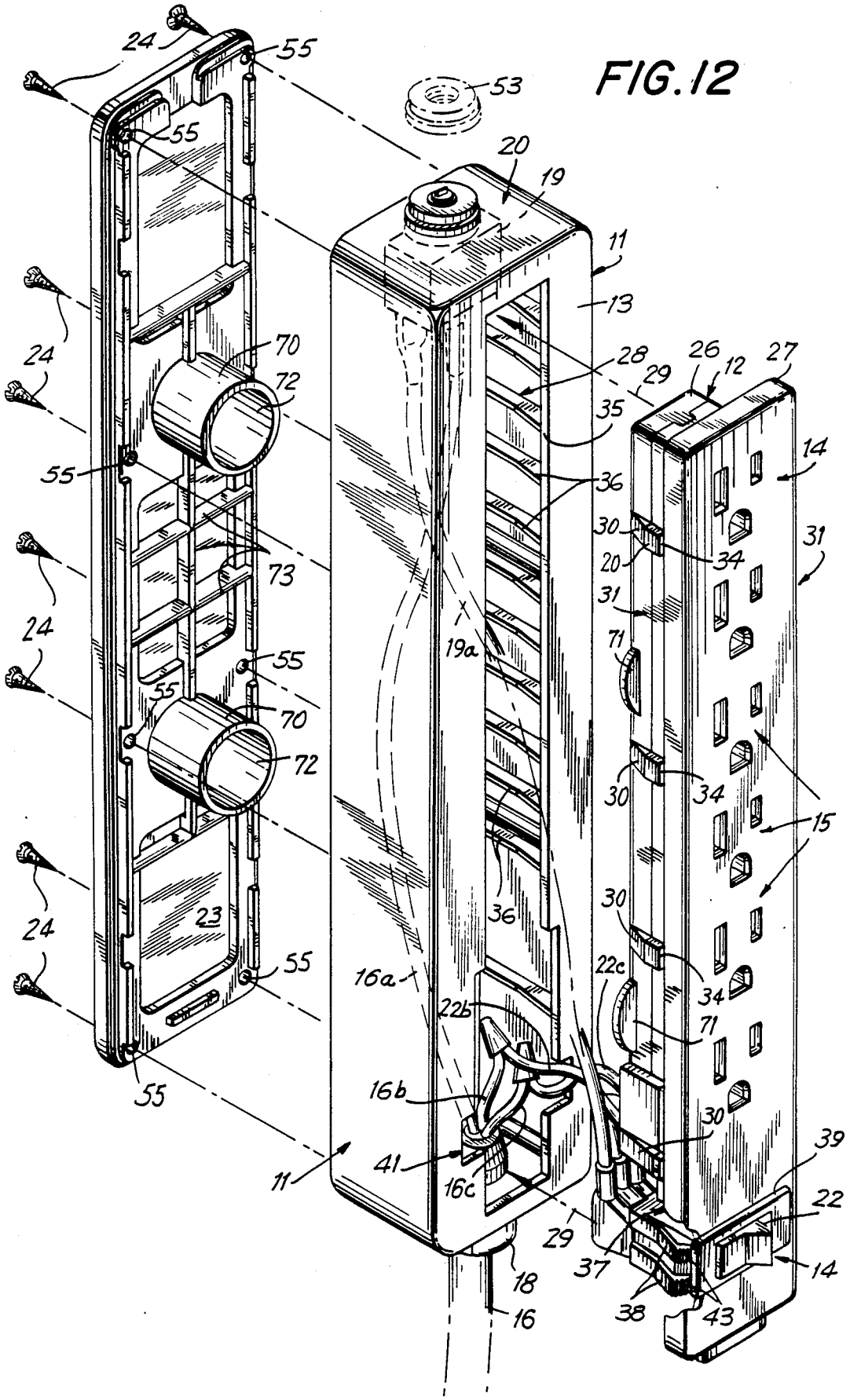
FIG. 12 is an exploded view depicting the assembly of the components of the electrical extension outlet illustrated in FIG. 1.

In FIG. 12, the base member 12 is shown as comprising a sealed casing 26, having a top flanged section 27 that has a wider diameter than the casing 26. The casing 26 fits (arrows 29) within the substantially rectangular aperture 28 disposed in the front surface 13 of housing 11. The casing 26 contains the contacts and wiring (not shown) necessary to power sockets 15 on the top surface 14 of base member 12. The sealed casing 26 provides isolation of the wiring and contacts of the sockets 15. The housing 11 provides a double shielding by further protecting the casting 26.

The flanged section 27 having a wider diameter than casing 26, acts as a limiting stop to the insertion (arrows 29) of the casing 26 within housing 11.

Figure 7:
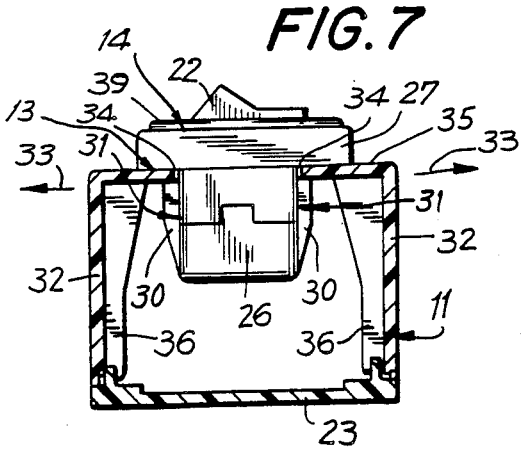
FIG. 7 is a sectional view of the electrical extension outlet shown in FIG. 6, taken along lines 7—7.

The ramp-type snap fasteners 30 disposed on both sides 31 of casing 26 (see FIG. 7), force the side walls 32 of housing 11 to flex outwardly (arrows 33) as the casing 26 is inserted into aperture 28. When the ends 34 of the snap fasteners 30 clear the top wall 35 of housing 11, the side walls 32 snap back to their original unflexed position, as shown in FIG. 7, causing the casing 26 to be firmly secured in housing 11 with the top flanged section 27 resting flush with the top surface 13 of the housing 11.

While the side walls 32 of housing 11 are flexible, there is also provided internal molded skeletal ribs 36 along the inner sides of wall 32 to give structural and mechanical strength to wall 32 in a vertical direction.

Figure 11:
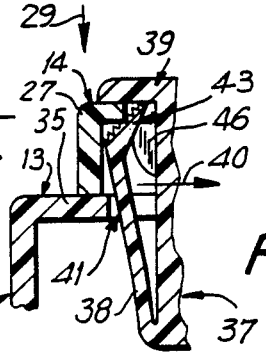
FIG. 11 is a sectional view of the electrical extension outlet depicted in FIG. 6, taken along lines 11—11.

The rocker switch 22 is disposed in a case 37 that snap fastens into flanged section 27 of base member as best shown in FIG. 11. The cast 37 of switch 22 has flexible arms 3k8 that flex inwardly (arrow 40) on both sides of case 37, allowing the inward insertion into an aperture of the flanged section 27 when the top flange 39 of case 37 comes to rest upon the top surface 14 of flanged section 27. A saw-toothed ramp 43 of arm 38 locks the case 37 in place (ratchet-style) with respect to the flanged section 27. The case 37 and arm 38 fit within aperture 41 (arrow 29) of the top surface 13 of housing 11, as illustrated in FIGS. 11 and 12. An abutment 46 prevents the flexing of ramp 43 with respect to flanged section 27 in order to provide a secure locking fit of case 37 in base member 12.

The switch 22 is connected to leads **16*b* and 16*c* of power cord 16 via wire leads 22*b* and 22*c*, respectively. The lead 16*a* of the power cord 16 is connected to circuit breaker 19 as shown. The current from lead 16*a* is fed from the circuit breaker 19 to the switch 22 via electrical wire lead 19*a***.

Figure 8:
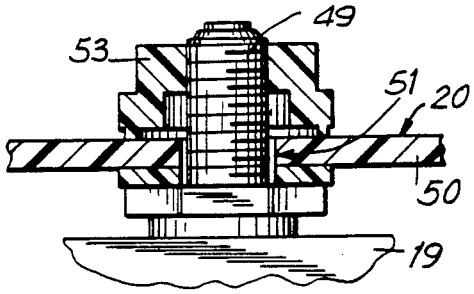
FIG. 8 is a sectional view of the electrical extension outlet depicted in FIG. 6, taken along lines 8—8.
Figure 9:
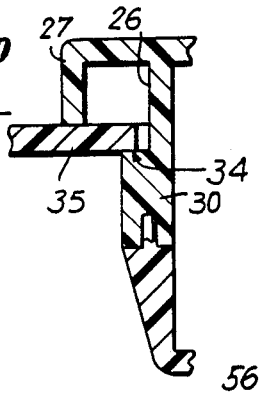
FIG. 9 is a sectional view of the electrical extension outlet illustrated in FIG. 6, taken along lines 9—9.

The circuit breaker 19 is affixed to the top end 20 of housing 11 by inserting the threaded post 49 of circuit breaker 19 through an aperture 51 in the top end side wall 50, and then rotatively securing locking cap 53 thereon, as shown in FIG. 8.

Figure 10:
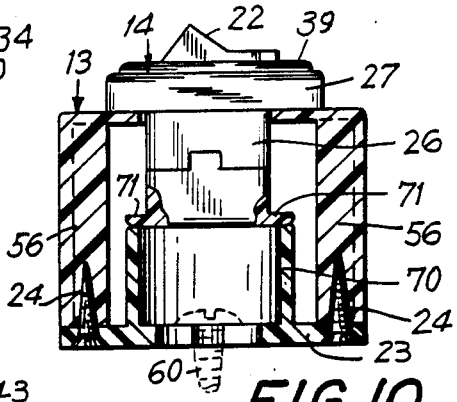
FIG. 10 is a sectional view of the electrical extension outlet shown in FIG. 6, taken along lines 10—10.

The rear plate 23 is secured to the housing 11 by means of metal screw fasteners 24, as aforementioned. The screw fasteners 24 are inserted through screw holes 55 (FIG. 12) in rear plate 23 and screw into blind holes in side posts 56 of the housing 11, as illustrated in FIG. 10. In this way, wires **16*a* and 19*a*** are isolated.

Figure 6:
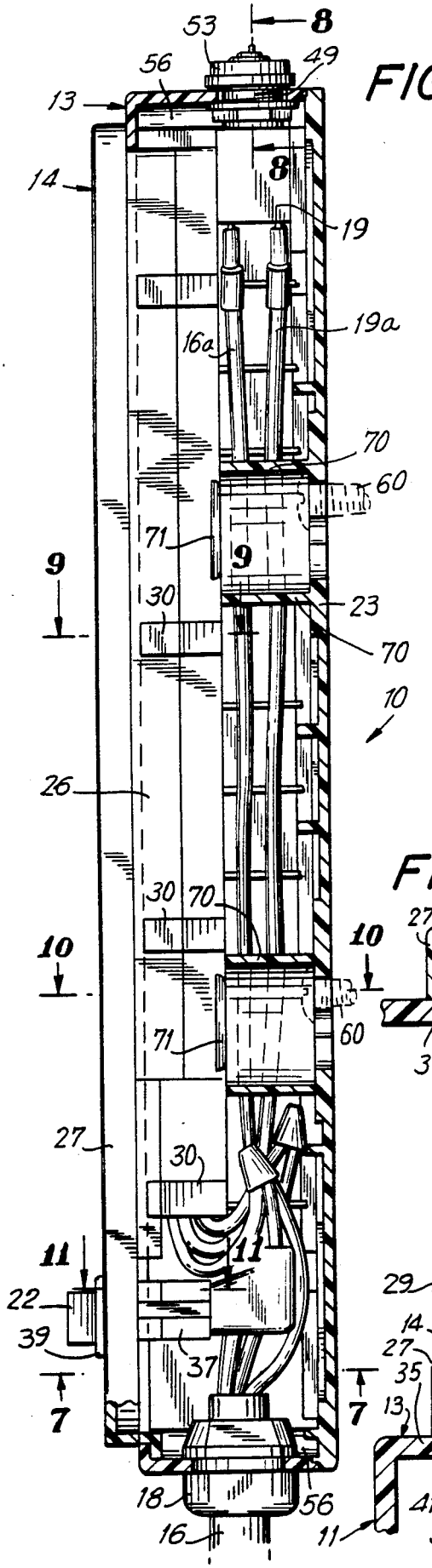
FIG. 6 is a sectional view of the electrical extension outlet illustrated in FIG. 1, taken along lines 6—6.

The outlet 10 can be mounted or affixed to a wall by mounting screws 60 that fit into apertures 25 in the rear plate 23, as shown in FIGS. 6 and 10. The leads of the screws 60 tighten rear plate 23 to a wall, and are disposed in hollow cylindrical wells 70 (see FIGS. 6, 10 and 12). The flange 71 of casing 26 cover the openings 72 of wells 70, such that the wires **16*a* and 19*a* are isolated from the metal mounting screws 60**.

The rear plate 23 is provided with skeletal ribs 73 to provide structural and mechanical strength to rear plate 23.

The circuit breaker 19 has its own casing.

It can be seen from the foregoing description that the outlet 10 of this invention is easily asembled by means of snap action fasteners, and safeguards internal wiring and contacts by structural shielding and isolation from metal fasteners.

It is also to be noted that the casing 26 housing socket wiring and contacts is separated from the internal wires **16*a*, 16*b*, 16*c*, 19*a*, 22*b* and 22*c***.

Thus, the present invention provides improved assembly and electrical safety.

Having thus described the invention, what is desired to be protected by Letters Patent is presented in the subsequent appended claims.

What is claimed is:

1. An easily assembled electrical extension outlet having a multiplicity of electrical sockets disposed in seriatim about an elongated base member, said extension outlet comprising:

a housing having a substantially rectangular shape and means defining front and rear apertures and blind fastener receptacles;

a rear plate for covering the rear aperture of said housing, said rear plate being affixable to said housing by means of fasteners which extend into said blind fastener receptacles;

a base member having means for snap fastening said base member into said front aperture of said housing, said base member having a flange extension that extends over said front aperture, said base member having a top surface containing a multiplicity of socket holes defining a number of individual sockets, said base member containing in isolation wiring and contact means for establishing isolated electrical connection to each individual socket;

a switch disposed in said top surface of said base member and electrically connected to each individual socket, said switch having means for snap fastening said switch into said base member;

a power cord entering into said housing; and a circuit breaker disposed within said housing and electrically connected between said power cord and said switch, said rear plate having means defining rear plate apertures for receiving wall mounting fasteners, said rear plate having means for electrically isolating said rear plate apertures, whereby said wall mounting fasteners do not come into contact with internal wiring, said means for isolating said rear plate apertures comprising cylindrical wells integrally formed in said rear plate, each well surrounding a respective rear plate aperture, and wherein said base member has internal flanges for covering each cylindrical well.

2. The electrical extension outlet of claim 1, wherein said switch comprises an illuminating rocker that indicates when said sockets are electrically powered.

3. The electrical extension outlet of claim 1, wherein said power cord is affixed to a sidewall of said housing by means a strain relief grip.

4. The electrical extension outlet of claim 1, wherein said rear plate comprises an impact-resistant skeletal molding.

5. The electrical extension outlet of claim 1, wherein said rear plate has means defining rear plate apertures for receiving wall mounting fasteners, said rear plate having means for electrically isolating said rear plate apertures, whereby said wall mounting fasteners do not come into contact with internal wiring.

6. The electrical extension outlet of claim 5, wherein said means for isolating said rear plate apertures comprises cylindrical wells integrally formed in said rear plate, each well surrounding a respective rear plate aperture.

7. The electrical extension outlet of claim 1, wherein said circuit breaker is encased in a separate casement within said housing to electrically isolate said circuit breaker within said extension outlet.

8. The electrical extension outlet of claim 7, wherein said circuit breaker is affixed to said housing along a sidewall thereof by means of a screw cap that tightens about a screw threaded post disposed on said circuit breaker casement, said screw threaded post extending through a hole in said sidewall for receiving said screw cap.

9. The electrical extension outlet of claim 1, wherein said housing comprises an impact-resistant skeletal molding.

10. The electrical extension outlet of claim 9, wherein said housing is flexible to accommodate snap-action assembly of said base member.

11. An electrical extension outlet having a multiplicity of electrical sockets disposed in seriatim about an elongated base member, said sockets having contacts which are wired together in common ground and are doubly electrically isolated by means of being disposed within a base member which is itself encased in a housing; said base member being easily assembled to said housing by means of irreversible snap fasteners integrally molded about said base member, said extension outlet further comprising a rear plate affixed to said housing, wherein said housing comprises blind fastener receptacles for receiving fasteners for affixing said rear plate to said housing, wherein said rear plate having holes for mounting said outlet to a wall by means of fasteners, wherein said rear plate comprising isolation wells, each surrounding a mounting hole, whereby a metal fastener is prevented from contact with internal wiring in said housing, and wherein said base member has flanges that fit over said isolation wells of said rear plate, whereby said isolation wells are sealed from said internal wiring of said housing.

12. The electrical extension outlet of claim 11, further comprising a rear plate affixed to said housing.

13. The electrical extension outlet of claim 12, wherein said housing comprises blind fastener receptacles for receiving fasteners for affixing said rear plate to said housing.

14. The electrical extension outlet of claim 12, wherein said rear plate has holes for mounting said outlet to a wall by means of fasteners.

15. The electrical extension outlet of claim 14, wherein said rear plate comprises isolation wells, each surrounding a mounting hole, whereby a metal fastener is prevented from contact with internal wiring in said housing.

* * * * *